United States Patent [19]

Bisbing

[11] 4,023,839

[45] May 17, 1977

[54] PUSH BUTTON LATCH

[75] Inventor: Robert H. Bisbing, Springfield, Pa.

[73] Assignee: Southco, Inc., Lester, Pa.

[22] Filed: Jan. 29, 1976

[21] Appl. No.: 653,344

[52] U.S. Cl. ..... 292/85; 292/DIG. 38

[51] Int. Cl.[2] ..... E05C 3/08

[58] Field of Search ..... 292/109, 85, 100, 87, 292/126, 220, DIG. 49, DIG. 38, 341–348

[56] References Cited

UNITED STATES PATENTS

| | | | |
|---|---|---|---|
| 125,320 | 4/1872 | Moore | 292/126 |
| 311,025 | 1/1885 | Mitrucker | 292/85 X |
| 634,332 | 10/1899 | Gardner | 292/85 |
| 3,918,754 | 11/1975 | Isbister | 292/DIG. 38 |

*Primary Examiner*—Richard E. Moore
*Attorney, Agent, or Firm*—Paul & Paul

[57] ABSTRACT

Described is a latch assembly designed to be affixed to and to secure together two closure members at their abutting edges. A flexible portion of a latch body allows the latch to snap over and then engage a keeper when the edges of the closure members are brought together. For unlatching, a push button actuator is incorporated to cause the flexible element to flex outwardly, thereby releasing the latch from engagement with the keeper and permitting separation of the closure members.

8 Claims, 7 Drawing Figures

PUSH BUTTON LATCH

BACKGROUND OF THE INVENTION

This invention relates to the field of fastening devices which are used to secure together the abutting edges of coplanar panels and the like. More particularly, this invention pertains to latches or catches which operate by a snapping and locking action when the edges of such panels are brought together.

In the prior art, fastening devices in this field have been constructed in various ways. One type in common use provides a spring element which allows the latching surface to pass over a keeper element by means of a camming surface urged into engagement with the keeper. To release this type of latch, a handle element must be provided to pull against the spring force to separate the latch and keeper surfaces. The handle of such a latch protrudes well beyond the dimensions of the body of the latch, and consequently the configuration is objectionable in appearance and may prohibit use of the latch in certain confined areas. A leaf type spring is commonly used in such latches and a weakness of prior spring latch designs is the probability of overstressing the spring when pulling the attached handle to release the latch. Another type of fastener used in this general field is known as a draw pull catch, one form of which is shown in my prior U.S. Pat. Nos. 3,181,905 and 3,466,076. However, such draw pull catches do not snap automatically to a locked position since they lock by a draw pull action. Moreover, they require a lifting force for disengagement of the latch from the keeper and this is a disadvantage in some cases.

SUMMARY OF THE INVENTION

A primary object of the present invention is to provide a latch at the abutting edges of two closure members wherein latching is easily accomplished by snap action of a flexible latch body element over a keeper when the closure members are brought together and, particularly, to provide easy unlatching by depressing a push button and thereby causing a flexing movement of the latching element to move it outwardly clear of the keeper. The flexible latching element is protected from failure due to overstressing during unlatching by limiting the extent of flexing of the latching element.

Another object of the invention is to provide for low cost manufacture of such a latch device.

A further object of the invention is to provide such a latch device which may be quickly, simply and economically installed on closure members.

A further object of the invention is to insure that the abutting edges of the closure members be held tightly together without looseness or play.

A still further object is to provide an adjustable keeper element.

The above objects are accomplished in a preferred embodiment of the present invention wherein the unlatching operation is facilitated by a push button action of a latch actuator in which the button travel is limited by a positive stop. The flexure imparted to the flexible element of the latch body is thereby controlled to avoid damage due to overstressing.

The embodiments hereinafter described are readily adapted to being fabricated from a low cost thermoplastic material by an economical molding process. Further economies are realized at installation of the preferred embodiment in that simple application of a spring clip to a stud member integral with the latch completes installation of the latch. Likewise, the keeper is installed on the other closure member by a spring clip applied to a stud integral with the keeper.

The tight fitting condition afforded by the matching angles of the mating surfaces of the latch and keeper is assured in the preferred embodiment by the attachment stud of the keeper being positioned eccentric to the outside diameter of the keeper. Rotation of the keeper about the stud thus provides adjustment of the keeper to the optimum position.

DETAILED DESCRIPTION OF THE PREFERRED EMBODIMENT

Figure 3:
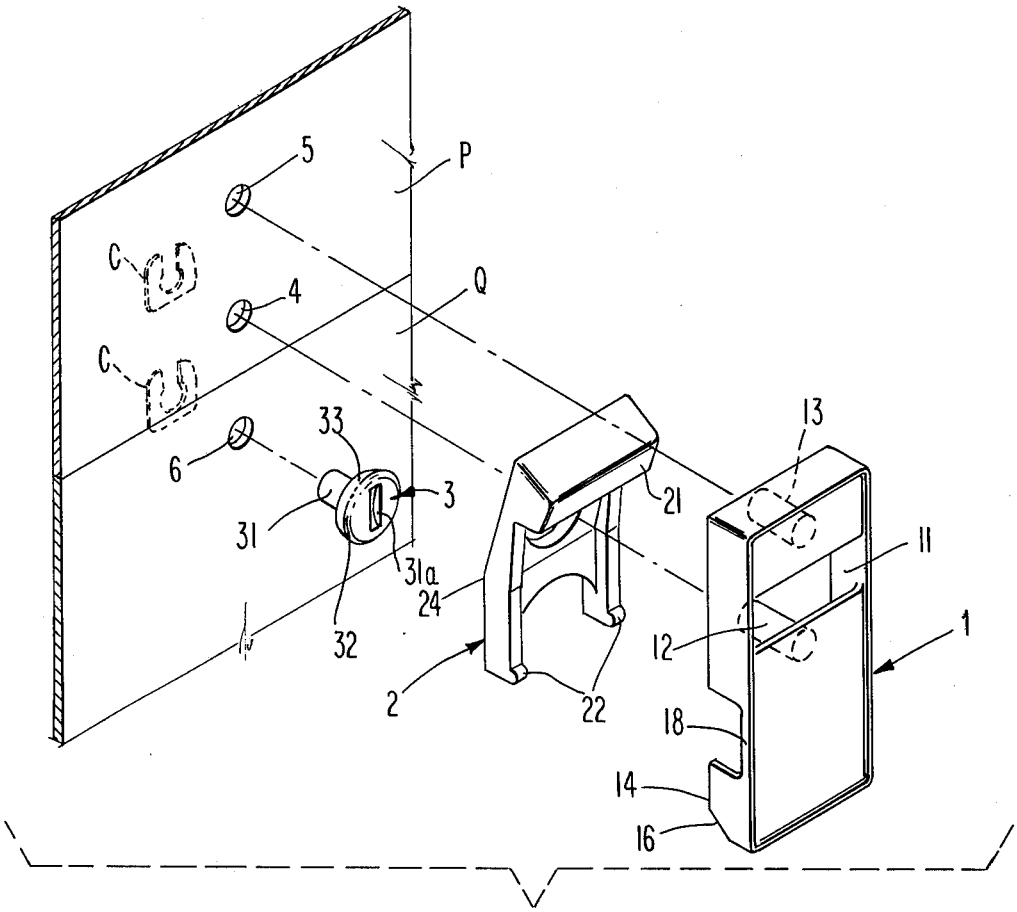
FIG. 3 is an exploded perspective view of the components of the fastener relative to the upper and lower panels.

Referring to FIG. 3, the preferred embodiment of the present invention is seen to consist of three components: latch body 1, actuator 2 and keeper 3. Spring clips C are shown which secure the attachment of latch body 1 and keeper 3 to panels or closure members P and Q, respectively.

Figure 1:
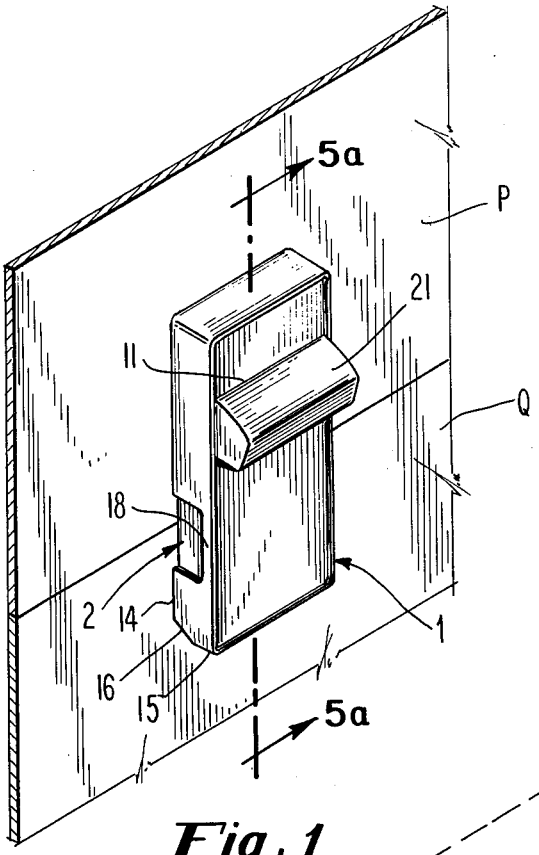
FIG. 1 is a perspective view of the fastener mounted to upper and lower panels and in locked position.

Referring now to FIGS. 1 and 3, actuator 2, when assembled, fits within latch body 1 with push button 21 protruding through opening 11. Attachment of latch body 1 to panel P may be accomplished using any of several types of standard fastening devices or an integral fastening element may be incorporated in the design of the latch. Referring again to FIG. 3, the preferred embodiment includes stud 12 as an integral element of latch body 1. Stud 12 provides attachment means by passing through a prepared hole 4 in panel P where it is held in position by spring Clip C. An additional stud 13 on the latch body 1 enters a second hole 5 in panel P to prevent rotation of the assembly in the plane of panel P. This stud may be fastened to panel P by a clip but need not be since stud 12 is fastened to the panel. Likewise, keeper 3 is secured to panel member Q by inserting stud 31 through hole 6 and fastening it by a clip C.

Figure 4:
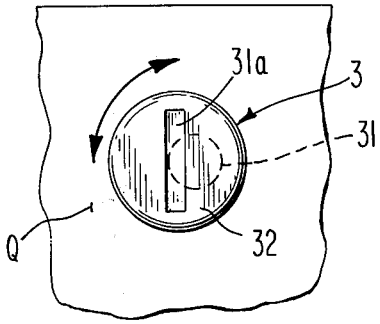
FIG. 4 is an elevational view of the eccentric keeper.
Figure 2:
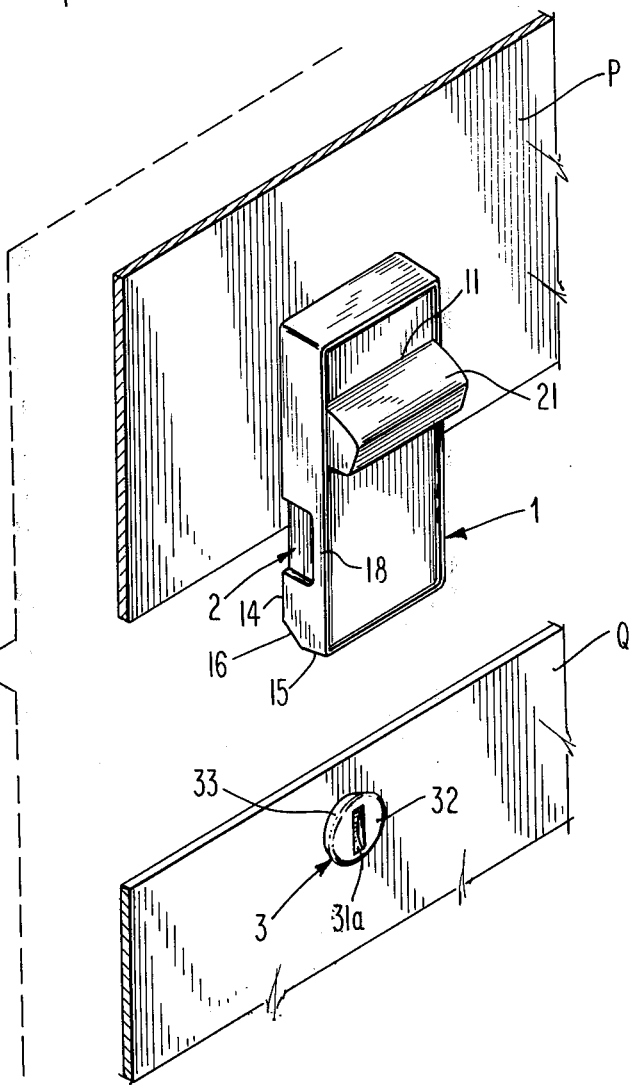
FIG. 2 is a perspective view showing the fastener and panels of FIG. 1 in unlocked position.
Figure 5C:
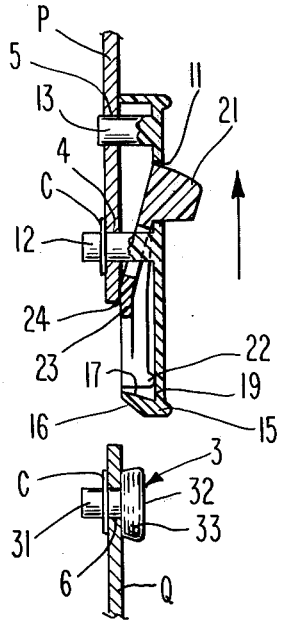
FIG. 5*c* is a view similar to FIG. 5*b* showing the latch removed from the keeper and the panels separated from each other.
Figure 5B:
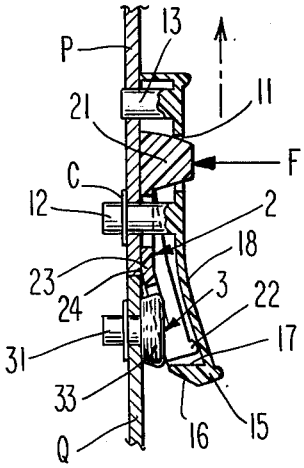
FIG. 5*b* is a view similar to FIG. 5*a* showing the latching mechanism flexed outwardly from the keeper.
Figure 5A:
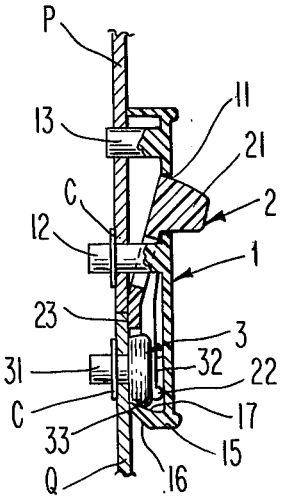
FIG. 5a is a cross-sectional view taken along the line 5*a*–5*a* of FIG. 1.

Referring now to FIG. 5*a*, with the assembly installed and in locked position, the normal position of straight edges 23 of actuator 2 are substantially in the plane of the surfaces of panels P and Q. Similarly, edges 14 of latch body 1 are in the plane of the surfaces of panels P and Q, as shown in FIG. 1. Actuator 2 so fits inside latch body 1 that protrusions 22 contact or nearly contact the inside surface 19 near latching end 15 of the latch body 1. When the latch is in the fastened condition, the abutting edges of panels P and Q are secured together by the engaging contact of interior surface 17 of latch body 1 with perimetric surface 33 of keeper 3. The top portion 32 of the preferred embodiment of keeper 3 has the general shape of the frustrum of a cone with perimetric surface 33 being tapered. Stud portion 31 is located on the smaller diameter surface of keeper 3 and is eccentric to the circumference of the keeper as shown in FIG. 4. Slot 31*a* is provided for insertion of a screw driver or coin for rotating keeper 3, thereby adjusting it to an optimum latching position.

Referring now to FIG. 5*b*, to accomplish the unlatching operation, push button 21 of actuator 2 is pushed toward panel P causing actuator 2 to pivot about fulcrum edge 24 which bears on the surface of panel P. Protrusions 22, in contact with the interior surface 19 of latch body 1, lift latching end 15 of latch body 1 outwardly away from the surface of panel Q a distance equal to at least the height of top portion 32 of keeper 3. Flexible spring portion 18 of latch body 1 flexes outwardly to allow this lifting of latching end 15 so that the abutting edges of panels P and Q can be parted. A smooth flexing curve in flexible portion 18 is obtained by providing a cut out in each of the side walls of latch body 1. The surface of panel P serves as a stop to limit the travel of push button 21 as shown in FIG. 5b.

In latching operation, coplanar panels P and Q are urged toward one another to butt edges, flexible spring 18 flexes due to the camming action of inclined surface 16 of latch body 1 in contact with top portion 32 of keeper 3 lifting the latching end 15 of latch body 1 slidably across the top of keeper 3. Spring 18 then returns to its unflexed position and urges latching end 15 back toward the plane of the panel surface Q, thereby engaging interior surface 17 with perimetric surface 33 of keeper 3. In the preferred embodiment, surface 17 is set at an angle to substantially mate with the taper of perimetric surface 33 of keeper 3, thus providing snug engagement and resisting accidental release.

Having thus described my invention by reference to a preferred embodiment as illustrated herein, I claim:

1. A push button latch comprising, in combination, a latch body and an actuator positioned within said body in operative engagement therewith, said body having front, side and end members, said front member being flexible in a direction substantially perpendicular to the plane of its outer face, an opening formed in said front member, inwardly facing keeper engagement means integral with said front member and spaced apart from said opening, a push button formed toward one end of said actuator and operatively positioned within said opening, whereby inward depression of said push button causes outward motion of the opposite end of said actuator, causing an outward motion of said front member of said latch body.

2. The push button latch of claim 1 further characterized by mounting studs projecting from the inner surface of said latch body and adapted to engage openings in a panel.

3. The push button latch of claim 1 further characterized by spaced apart legs integral with the actuator and positioned for operative engagement with the inner surface of said latch body.

4. The push button latch of claim 2 further characterized by an opening formed in said actuator through which one of said mounting studs extends.

5. The push button latch of claim 3 further characterized by a fulcrum edge formed toward the top of the actuator legs, said fulcrum edge providing a pivot contact around which said actuator rotates on depression of said push button.

6. The push button latch of claim 1 further including cut out portions in the side members of said latch body.

7. The push button latch combination of claim 1 further characterized by mounting studs attached to the inner surface of said front member at one end and engaging openings in a first panel at the other end, and a keeper having a mounting stud with said mounting stud engaging an opening in a second panel whereby said first and second panels are locked in abutting relationship when said keeper engagement means engages said keeper.

8. The combination of claim 7 in which the keeper mounting stud is attached to the keeper at a position eccentric to the outside diameter of the keeper thereby providing positional adjustment of the keeper on rotation thereof.

* * * * *